United States Patent [19]

Sinnes

[11] Patent Number: 5,032,041

[45] Date of Patent: Jul. 16, 1991

[54] JOINING DEVICE ESPECIALLY FOR CONCRETE PILES

[75] Inventor: Sven A. Sinnes, Royneberg, Norway

[73] Assignee: Norsk Spennbetong A/S, Sola, Norway

[21] Appl. No.: 478,948

[22] Filed: Feb. 12, 1990

Related U.S. Application Data

[63] Continuation of Ser. No. 202,014, Jun. 3, 1988, abandoned.

[30] Foreign Application Priority Data

Jul. 1, 1987 [NO] Norway ..... 872739

[51] Int. Cl.[5] ..... E02D 5/12

[52] U.S. Cl. ..... 405/252; 403/379

[58] Field of Search ..... 405/251, 252; 403/61, 403/100, 102, 378, 379

[56] References Cited

FOREIGN PATENT DOCUMENTS

| | | |
|---|---|---|
| 749631 | 1/1967 | Canada . |
| 104170 | 4/1964 | Norway . |
| 691722 | 5/1953 | United Kingdom . |
| 2171741 | 9/1986 | United Kingdom . |

*Primary Examiner*—Dennis L. Taylor
*Assistant Examiner*—Arlen Olsen
*Attorney, Agent, or Firm*—Foley & Lardner

[57] ABSTRACT

A joining device, especially for concrete piles, comprises at least one wedge (12). In order to provide a joining device which is strong, cheap in production and very simple in use, at least the one pile end has a female joint (2) for receiving a male joint or a male joint similar tension body (10) at the during the joining adjacent co-operating pile end. The female joint(s) (2) and the male joint/the male joint similar tension body (10) have through-going cavities or holes (9',11) for at least one common lateral wedge (12).

7 Claims, 6 Drawing Sheets

JOINING DEVICE ESPECIALLY FOR CONCRETE PILES

This application is a continuation of application Ser. No. 202,014, filed June 3, 1988, now abandoned.

BACKGROUND OF THE INVENTION

1. Field of the Invention

The present invention relates to a joining device, especially for concrete piles, and of the kind further defined in the preamble of claim 1.

2. Discussion of the Related Art

Concrete piles are commonly provided with a steel plate at each end. The steel plates cover the end surfaces of the concrete piles and may each form a part of an end cap of steel. When the concrete piles are to be joined to each other, this takes place through mutual anchoring of the steel plates, e.g. by means of bayonet joints or similar locking means. However, known locking means for the purpose concerned are expensive in production, cumbersome in use and often not without play.

Thus, in such known joining devices for concrete piles it is the end plates of steel that form the anchoring parts. The steel plates must, therefore, be dimensioned such that they can take up existing pressure stresses as well as existing tensile stresses and moments.

Furthermore, there is known a joining device for concrete piles wherein the piles at each end have a fastening body in each corner. This known joining device is voluminous, space-requiring and expensive.

Norwegian patent specification No. 140,170 concerns a joining device, especially for concrete piles, wherein pressure bodies in connection with wedges are used for the fastening. Also in this case, the pile ends are provided with steel plates or caps. At the other end, the pile is provided with a cavity the bottom of which forming rest for a wedge during its pressing-in into a split bolt, which is fixed in the co-operating pile end during the joining, such that the split bolt is wedged in the cavity by means of the wedge by the pressing-down of the upper pile. This known joining device is relatively complicated and requires great precision during the joining operation. It is emphasized that the wedge in this known joining device functions axially, i.e. in the longitudinal direction of the piles, therefore vertically. Such a wedge is, of course, not in a position to effect a desired pull of the two co-operating pile ends towards each other during the joining operation.

SUMMARY OF THE INVENTION

In accordance with the present invention one has, therefore, aimed to provide a joining device, especially for concrete piles, wherein disadvantages and shortcomings relating to the prior art are eliminated or substantially reduced. Consequently, the invention aims at providing a joining device, especially for concrete piles, which is cheap in production, very simple in use and having strength properties fully corresponding to the requirements set for taking-up existing compression and tensile stresses.

According to the invention, this object is achieved by means of the features appearing from the following claims.

In a joining device according to the invention, the end plates need only to take up plain pressure stresses, a tensile body being anchored independent of the steel plates and serves to take up the tensile loadings. One may, if desired, eliminate the end plates of steel in a joining device according to the invention, which involves a more simple production and an even cheaper joint.

The tension body of the joining device according to the invention may form a fixed male joint at the one pile end. In this case the opposite pile end is formed as a female joint. Such a male/female coupling is locked by means of one lateral wedge which during the driving-in works to pull the co-operating pile ends towards each other, such that they are tensioned against each other when the joint is established. Alternatively, both pile ends may be provided with female joints; one uses then a particular tension body which at first is wedged to the upper female joint of the one (lowermost) pile, whereafter the projecting portion of the tension body works as a male joint, which fits within the lower female joint of the other (uppermost) pile and is locked to the same by means of a lateral wedge. Such a separate tension body may be elongated and compact and have holes for the lateral wedges, or it may have the form of a oblong ring the opening of which forms the two wedge holes. The joint in accordance with the invention is very simple in use when utilizing one as well as two wedges.

During piling one typically uses a distinct pile having a front point. In the joining device according to the invention it is easy to arrange a loose point or shoe which is fastened to the following pile by wedging.

The invention is further explained in the following with reference to embodiments which are illustrated in the accompanying drawings, wherein:

BRIEF DESCRIPTION OF THE DRAWINGS

In FIGS. 1-3 the reference numerals 1 and 2 denote generally a male joint and a female joint, respectively, which are arranged coaxially with the axis of the concrete pile 3.

DETAILED DESCRIPTION OF THE PREFERRED EMBODIMENTS

Figure 1:
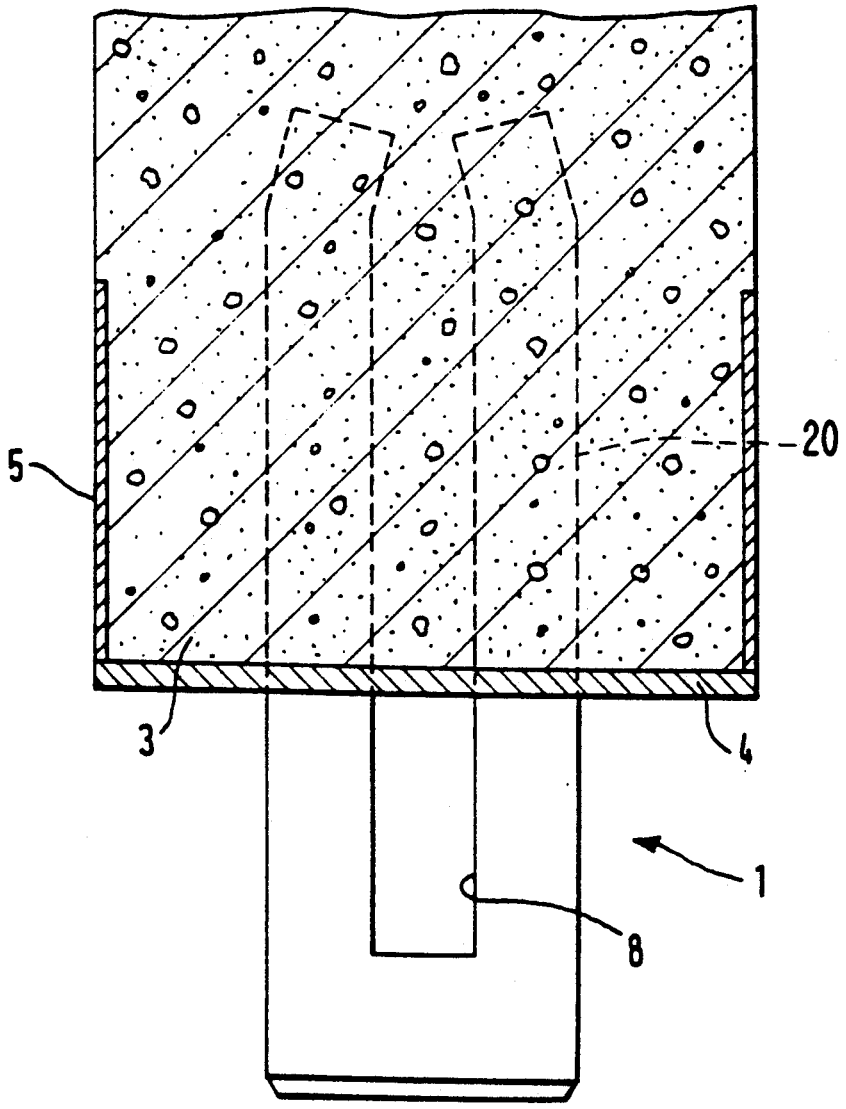
FIG. 1 shows in side view/vertical section a male joint at a (lower) pile end and which is shaped in accordance with a first embodiment of the invention.
Figure 4:
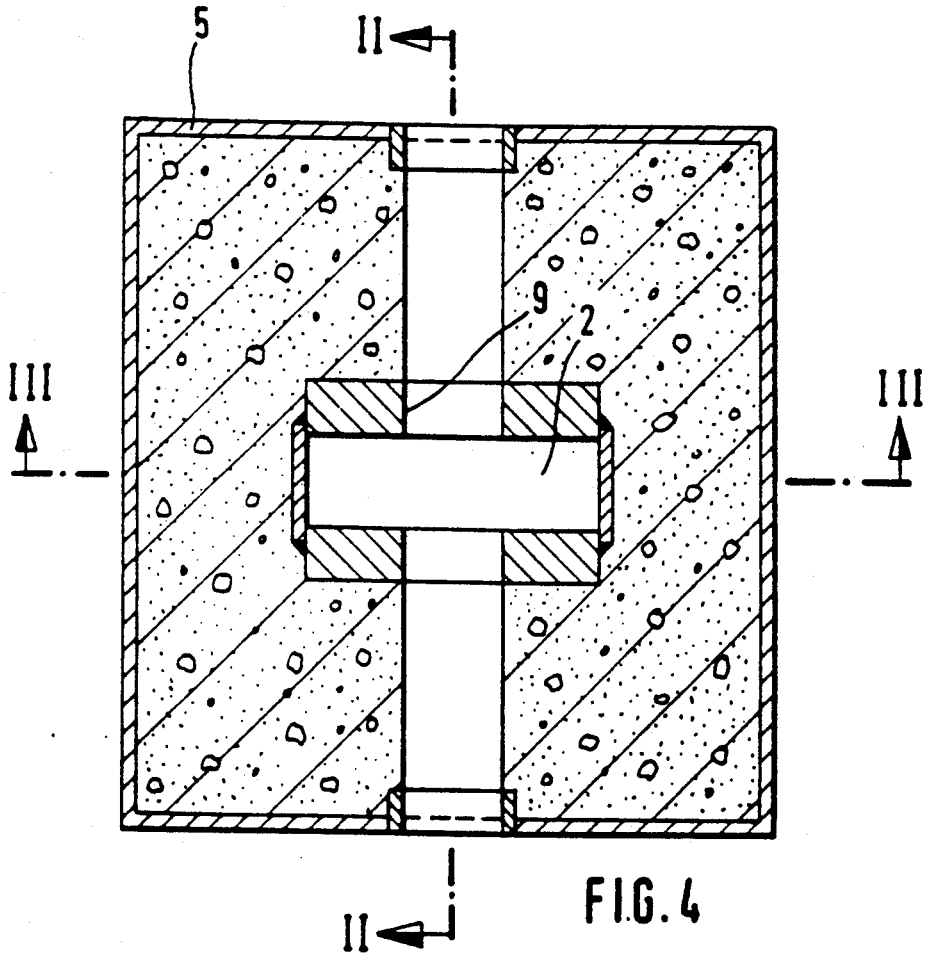
FIG. 4 shows a section along the line IV—IV in FIG. 3.
Figure 5:
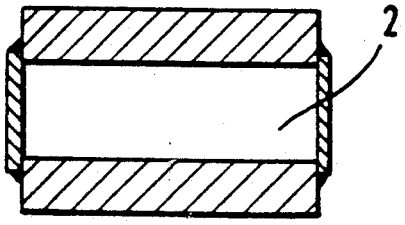
FIG. 5 shows a section along the line V—V in FIGS. 2 and 3.
Figure 6:
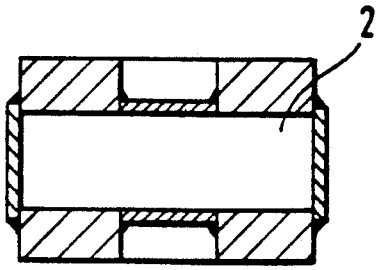
FIG. 6 shows a section along the line VI—VI in FIGS. 2 and 3.

As it appears especially from FIGS. 4–6, the female joints 2 have elongated rectangular cross-section, and the male joint 1 according to FIG. 1 has, of course, a corresponding cross-section having a little lesser dimensions than the female joint.

Figure 2:
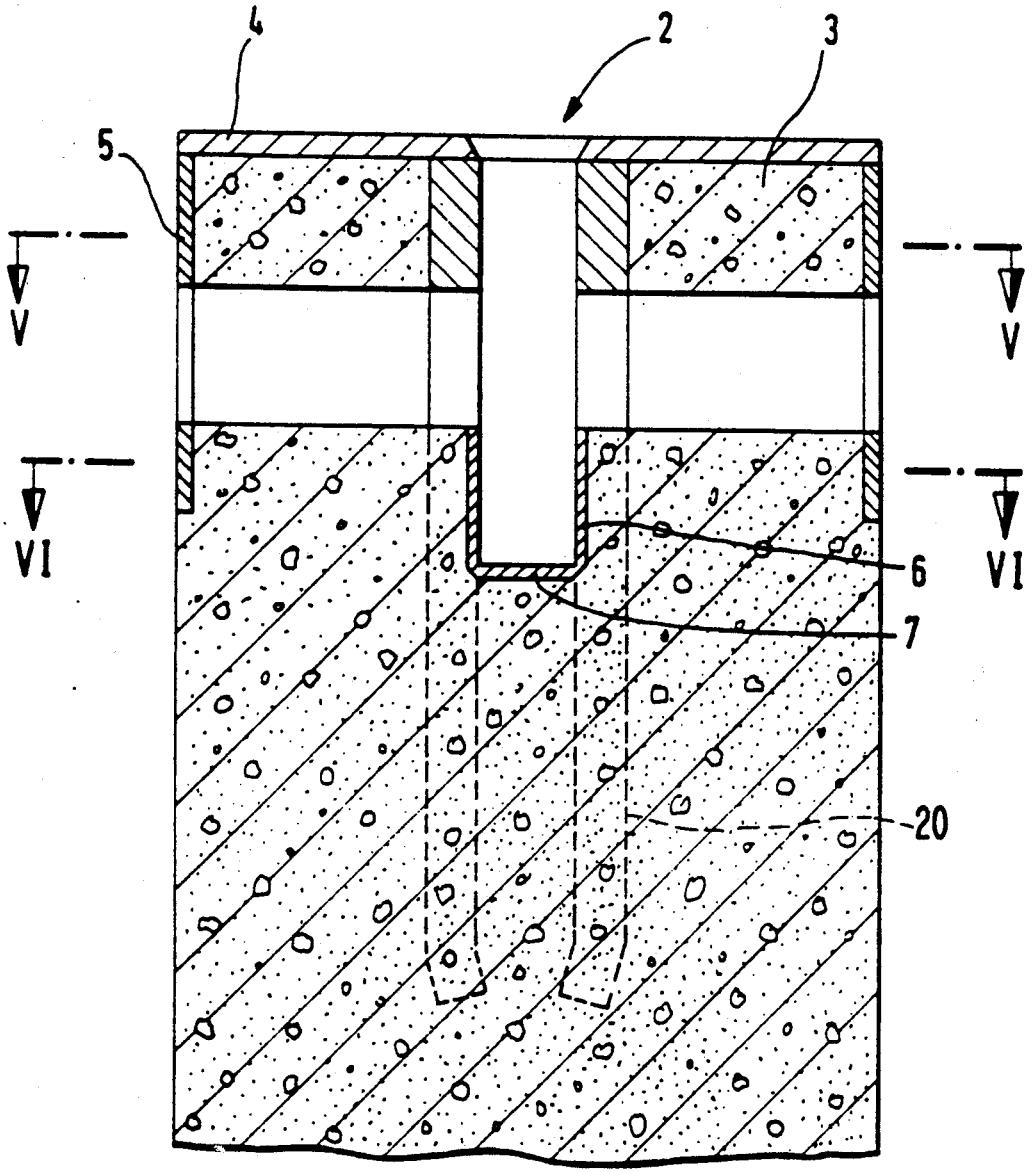
FIG. 2 shows in side view/vertical section (section II—II in FIG. 4) a corresponding female joint at a (upper) pile end and which is shaped in accordance with a first embodiment of the invention.
Figure 3:
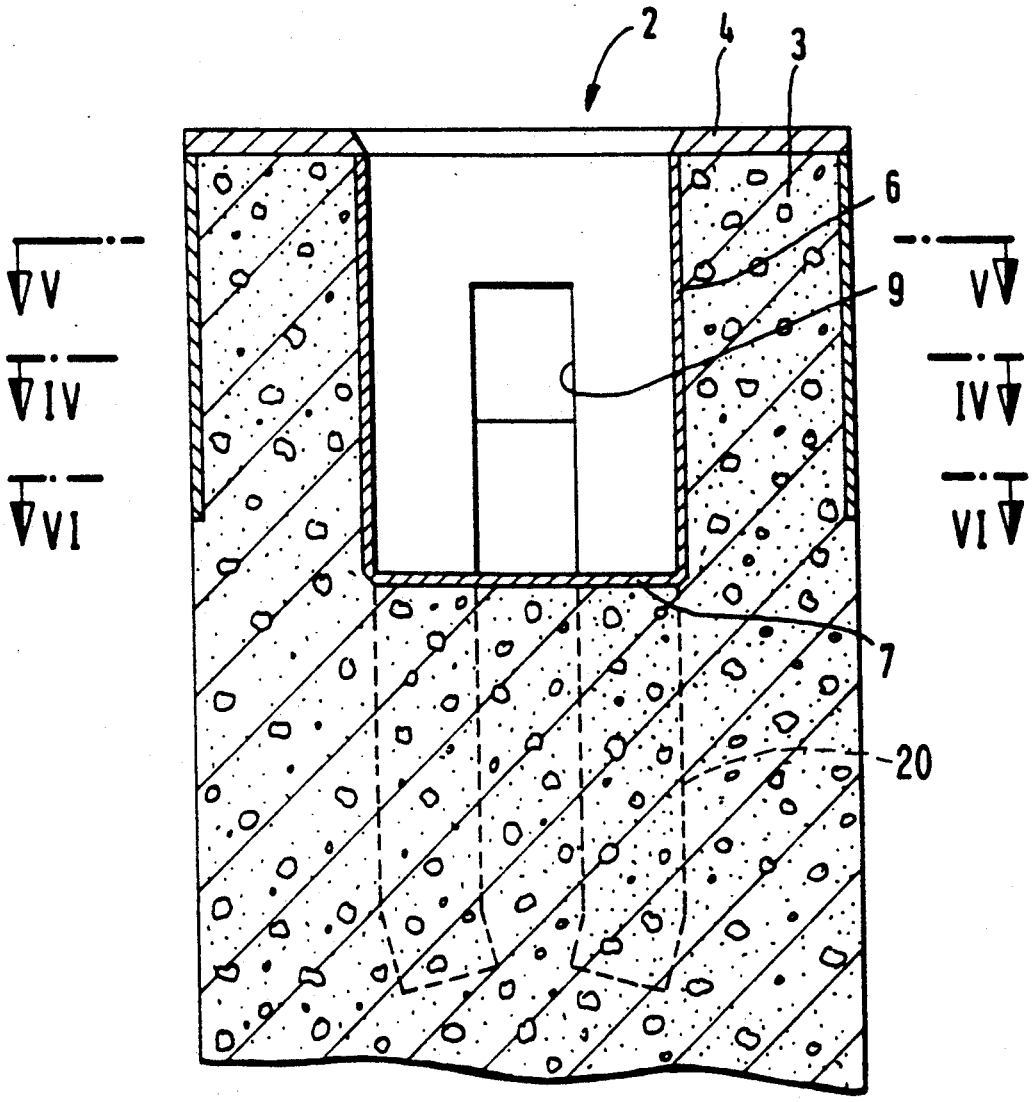
FIG. 3 shows the same as FIG. 2, but the section plane is angled 90 degrees in relation to that Figure, more exact along the line III—III in FIG. 4.

The male/female coupling is arranged in association to conventional end plates 4 of steel at the pile ends and which may form parts of end caps 5. Each female joint 2 is preferably lined with a sleeve 6 the bottom of which is denoted 7. As illustrated in FIGS. 1–3, both the male and female joints 1 and 2 are anchored in the piles via anchors 20 extending longitudinally beyond the sleeves. These anchors, by virtue of their longitudinally extending portions, provide resistance to bending forces imposed at the joints. As illustrated in FIGS. 2 and 3, the anchor 20 contacts the lateral sides of the sleeve 6 and extends longitudinally into said pile beyond the sleeve.

In the embodiments according to FIGS. 1–6, the male joint 1 as well as the female joint 2 are provided with lateral key grooves 8 and 9, respectively, for a common square-edge (not shown).

After the male joint 1 is inserted into the female joint at the adjacent co-operating pile end during the joining operation, the wedge is inserted into corresponding key holes 8, 9 and will during the driving-in in advantageous manner pull the pile ends towards each other, such that adjacent piles will be tensioned against each other after the joining has been effected.

Figure 7:
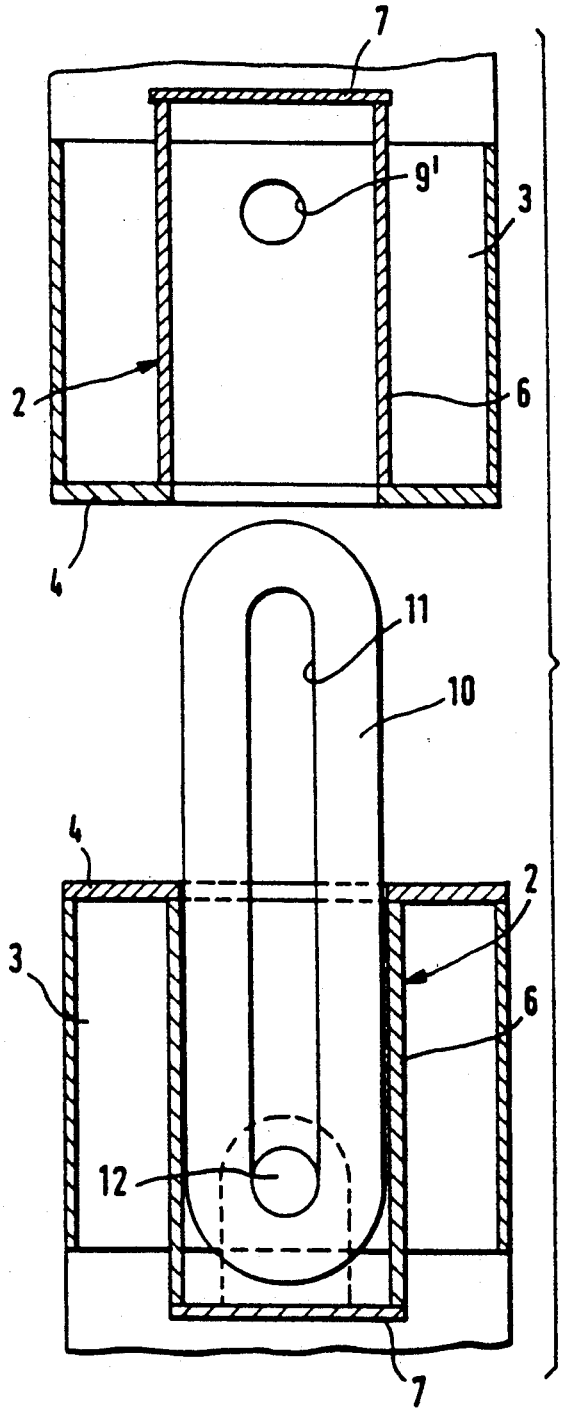
FIG. 7 shows in side view/vertical section a second embodiment of the joining device according to the invention, wherein is used a separate tension body in connection with two adjacent female joints and two lateral wedges.

FIG. 7 shows a second embodiment of the joining device according to the invention.

Here both pile ends are provided with their own female joint 2, which is lined with a sleeve 6 having a bottom 7.

In the embodiment according to FIG. 7 it is, instead of a male joint, used a separate tension body 10 in the form of an elongated ring, for example having circular cross-section, the opening 11 in the ring 10 being intended to receive lateral wedges 12, for example having circular cross-section such as a cone.

The tension body 10 is at first wedged in the female joint 2 of the bottom pile 3 before the top pile 3 is lowered over the projecting portion of the tension body 10, which thereby serves as a male joint. When the top pile is in place upon the bottom pile, the connection is secured by means of a further wedge (not shown) which is driven in through the opening 11 of the tension body 10 and the circular key hole 9' in the female joint 2 of the top pile.

Figure 8:
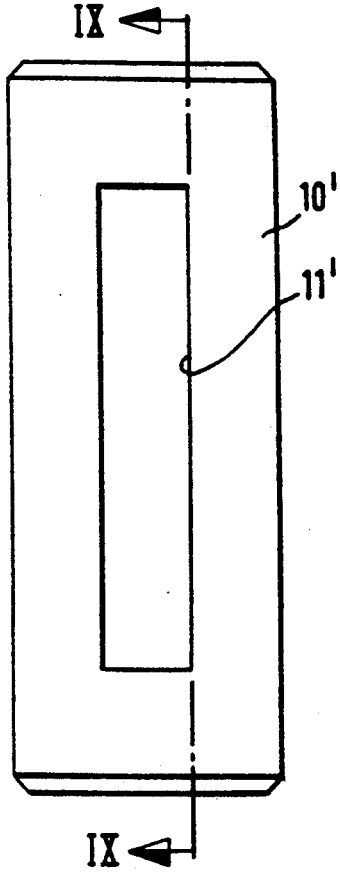
FIG. 8 shows a somewhat modified embodiment of the tension body shown in FIG. 7.

In FIG. 8 is shown a somewhat modified embodiment of the tension body according to FIG. 7. The tension body 10' in FIG. 8 has the same fundamental shape and mode of operation as the tension body 10 according to FIG. 7, but is produced from steel plate having a rectangular aperture 11' for two square-wedges, instead of metal rod.

Figure 9:
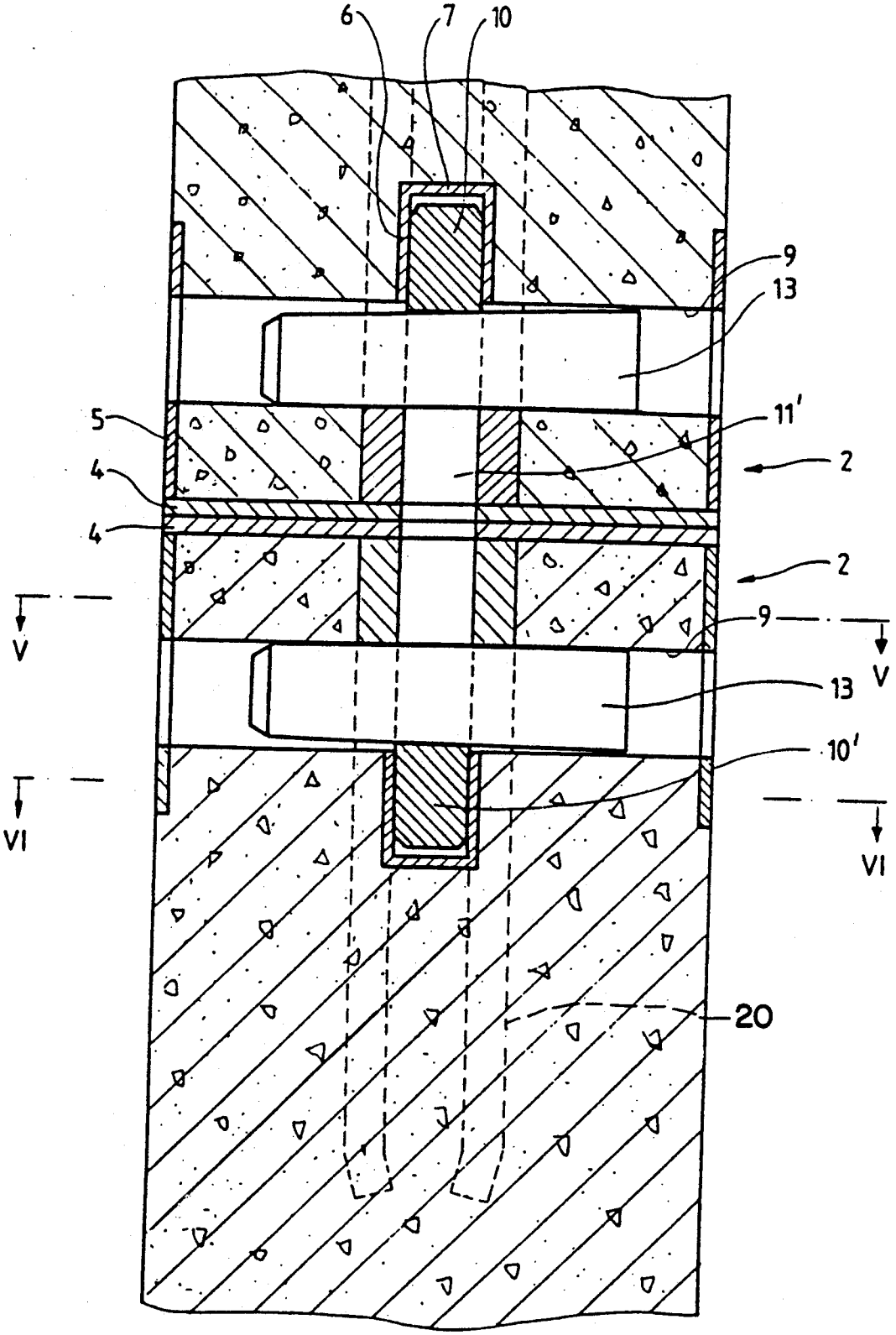
FIG. 9 is an axial cross-section showing two female joints, as in FIG. 2, joined by the tension body shown in FIG. 8.

FIG. 9 is an axial cross-section showing two female joints 2, as shown in FIG. 2, joined by the tension body 10' of FIG. 8. Two wedges 13 have been inserted into and extend through cooperating apertures 9 of the female joints 2 and through cooperating portions of the aperture 11' of tension body 10'. The wedges 13 are shown in their active positions, tensioning the body 10' and pulling the pile ends together to establish a strong and reliable joint.

I claim:

1. A joining assembly for concrete piles having a first, joining end and a second end, comprising:

a first and second pile to be joined;

a one-piece U-shaped member disposed at the joining end of the first pile, said U-shaped member having two leg portions joined by a base portion;

a female joint means for receiving the U-shaped member, said female joint means being disposed at the joining end of the second pile and being longitudinally reinforced via a reinforcing member, said reinforcing member comprising a sleeve embedded in the joining end of said second pile and an anchor which contracts lateral sides of said sleeve and which extends longitudinally into said pile beyond said sleeve; and at least one wedging means having a tapered axial cross-section;

said leg portions being directly anchored in the concrete of the joining end of said first pile, and said base portion extending therefrom to be received by said female joint means, said base portion and said female joint defining at least one pair of cooperating openings therein for receiving said wedging means so that the tapered axial cross-section of said wedging means acts on the cooperating openings of said base portion and said female joint to tension said first pile toward said second pile thereby prestressing the joining assembly.

2. A joining assembly for concrete piles having a first, joining end and a second end, comprising:

a first and second pile to be joined;

first and second female joint means disposed at the joining ends of the first and second piles, respectively;

at least first and second wedging means having a tapered cross-section;

a tension body having a first portion disposed in said first female joint at the joining end of said first pile;

said tension body and said first female joint defining at least one pair of cooperating openings therein for receiving said wedging means;

said tension body having a second portion disposed in said second female joint at the joining end of said second pile;

said tension body and said second female joint defining at least one pair of cooperating openings therein for receiving said wedging means;

wherein the tapered axial cross-sections of the wedging means act on the cooperating openings to directly anchor the tension body to the concrete of the piles and to tension the first pile toward the second pile thereby prestressing the joining assembly; and wherein each of said female joints is reinforced via a sleeve embedded in the joining end of the respective pile and in anchor which contacts the lateral sides of said sleeve and which extends longitudinally into the respective pile beyond said sleeve.

3. The joining assembly for concrete piles according to claim 2, wherein the tension body forms a continuous elongated ring.

4. The joining assembly for concrete piles according to claim 2, wherein said tension forms a continuous rectangular plate.

5. The joining assembly for concrete piles according to claim 2, wherein said tension body is formed from metal.

6. A method of joining concrete piles having a first, joining end and second end, comprising the steps of:

providing a first and second pile to be joined, said first pile having a one-piece U-shaped member extending therefrom, leg portions of said U-shaped member being directly anchored in the concrete of said first pile, said second pile having a female joint means for receiving said U-shaped member, said female joint means being longitudinally reinforced via a sleeve embedded in the joining end of said second pile and an anchor which contacts lateral sides of said sleeve and which extends longitudinally into said pile beyond said sleeve;

placing the joining ends of said first and second piles so that said U-shaped member is received by said female joint means;

defining at least one pair of cooperating openings in said female joint means and the extending portion of said U-shaped member; and driving a wedging means into each said pair of cooperating openings, so that said wedging means acts on said cooperating openings to longitudinally tension said first pile toward said second pile, thereby prestressing said first and second piles.

7. A method of joining concrete piles having a first, joining end and second end, comprising the steps of:

providing a first and second pile to be joined, said first and second piles having identical female joints at the joining ends thereof;

providing an integral tension body;

placing the joining ends of said first and second piles so that said tension body is received by the female joints of each pile;

defining at least one pair of cooperating openings in each said female joint and a respective portion of said tension body;

driving a wedging means into each said pair of cooperating openings, so that said wedging means acts on said cooperating openings to longitudinally tension said first pile toward said second pile, thereby prestressing said first and second piles; and wherein said step of providing first and second piles comprises the step of providing a female joint in each pile which is reinforced via a sleeve embedded in the joining end of the respective pile and an anchor which contacts the lateral sides of said sleeve and which extends longitudinally into the respective pile beyond said sleeve.

* * * * *